US009280132B2

(12) United States Patent
Nishiyama et al.

(10) Patent No.: US 9,280,132 B2
(45) Date of Patent: Mar. 8, 2016

(54) IMAGE FORMING APPARATUS INCLUDING PIVOTABLE PROCESS CARTRIDGE

(71) Applicant: BROTHER KOGYO KABUSHIKI KAISHA, Nagoya-shi, Aichi-ken (JP)

(72) Inventors: Hideshi Nishiyama, Owariasahi (JP); Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/663,065

(22) Filed: Mar. 19, 2015

(65) Prior Publication Data

US 2015/0277368 A1 Oct. 1, 2015

(30) Foreign Application Priority Data

Mar. 31, 2014 (JP) ..... 2014-074507

(51) Int. Cl.

| | |
|---|---|
| ***G03G 21/16*** | (2006.01) |
| ***G03G 21/18*** | (2006.01) |
| ***G03G 15/08*** | (2006.01) |
| ***G03G 21/12*** | (2006.01) |

(52) U.S. Cl.

CPC ..... *G03G 21/1814* (2013.01); *G03G 15/0865* (2013.01); *G03G 21/12* (2013.01)

(58) Field of Classification Search

CPC ... G03G 21/1814; G03G 21/12; G03G 15/00; G03G 15/0865

USPC ..... 399/111, 113, 119

See application file for complete search history.

(56) References Cited

U.S. PATENT DOCUMENTS

| | | | | |
|---|---|---|---|---|
| 6,330,410 | B1 * | 12/2001 | Okabe et al. | 399/113 |
| 6,546,217 | B2 * | 4/2003 | Okabe et al. | 399/113 |
| 6,622,001 | B2 * | 9/2003 | Arimitsu et al. | |
| 2003/0118368 | A1 | 6/2003 | Saito | |
| 2004/0046855 | A1 | 3/2004 | Saito | |
| 2004/0052547 | A1 | 3/2004 | Matsuura et al. | |
| 2005/0002683 | A1 | 1/2005 | Saito et al. | |
| 2005/0036802 | A1 | 2/2005 | Saito et al. | |
| 2009/0060567 | A1 * | 3/2009 | Mizuno et al. | 399/111 |
| 2011/0103825 | A1 * | 5/2011 | Numata et al. | 399/111 |
| 2011/0311269 | A1 * | 12/2011 | Murooka | 399/111 |
| 2012/0070185 | A1 * | 3/2012 | Yokota | 399/111 |

FOREIGN PATENT DOCUMENTS

| | | | |
|---|---|---|---|
| JP | 4-90561 | A | 3/1992 |
| JP | 2003-186291 | A | 7/2003 |
| JP | 2014-016484 | A | 1/2014 |

* cited by examiner

*Primary Examiner* — Susan Lee

(74) *Attorney, Agent, or Firm* — Merchant & Goulc P.C.

(57) ABSTRACT

There is provided an image forming apparatus including a main body and a process cartridge including a photosensitive body cartridge and a developing cartridge. The photosensitive body cartridge includes a photosensitive body and a waste developing agent storage container. The developing cartridge includes a developing agent carrier. The photosensitive body cartridge is configured to receive the developing cartridge such that the developing cartridge is attached to and detached from the photosensitive body cartridge through a particular space defined in the main body. The process cartridge is configured to pivot, with respect to the main body, between a first position, in which the waste developing agent storage container is positioned outside the particular space entirely, and a second position, in which the waste developing agent storage container at least partially occupies the particular space.

21 Claims, 10 Drawing Sheets

IMAGE FORMING APPARATUS INCLUDING PIVOTABLE PROCESS CARTRIDGE

CROSS-REFERENCE TO RELATED APPLICATION

This application claims priority from Japanese point Patent Application No. 2014-074507, filed on Mar. 31, 2014, which is incorporated herein by reference in its entirety.

TECHNICAL FIELD

Aspects described herein relate to an electrophotographic image forming apparatus, and more specifically, relates to an image forming apparatus including a process cartridge including a photosensitive body cartridge and a developing cartridge.

BACKGROUND

Known image forming apparatus include a process cartridge including a photosensitive body cartridge and a developing cartridge. In some image forming apparatus, the photosensitive body cartridge is configured to be attachable to and detachable from a main body of the image forming apparatus, and the developing cartridge is configured to be attachable to and detachable from the photosensitive body cartridge.

The photosensitive body cartridge includes a photosensitive drum to which a developing agent is supplied. The photosensitive drum is an example of a photosensitive body. The developing cartridge includes a developing roller for supplying a developing agent to a surface of the photosensitive drum. The main body of the image forming apparatus has an opening that is configured to open upward and enables the process cartridge, in which the developing cartridge is joined to the photosensitive body cartridge, to be attached to and detached from the main body.

SUMMARY

In the known image forming apparatus, in a case where a waste developing agent storage container for storing a developing agent collected from the surface of the photosensitive drum is disposed at the photosensitive body cartridge, the waste developing agent storage container may be forced to be disposed above and adjacent to the developing cartridge because there is no other space for placing the waste developing agent storage container.

Nevertheless, if the waste developing agent storage container is disposed above and adjacent to the developing cartridge, the waste developing agent storage container may obstruct attachment and detachment of the developing cartridge with respect to the photosensitive body cartridge.

According to one or more aspects of the disclosure, an image forming apparatus may include a main body and a process cartridge. The process cartridge may include a photosensitive body cartridge and a developing cartridge. The photosensitive body cartridge may include a photosensitive body configured to rotate on an axis and a waste developing agent storage container configured to store a developing agent collected from the photosensitive body. The developing cartridge may include a developing agent carrier configured to supply the developing agent to the photosensitive body. The photosensitive body may be configured to receive the developing cartridge such that the developing cartridge is attached to and detached from the photosensitive body cartridge through a particular space with respect to a direction orthogonal to the axis. The particular space may be defined in the main body. The process cartridge may be configured to pivot, with respect to the main body, between a first position, in which the waste developing agent storage container is positioned outside the particular space entirely, and a second position, in which the waste developing agent storage container at least partially occupies the particular space.

According to one or more other aspects of the disclosure, an image forming apparatus may include a main body having a main opening, a process cartridge, a feeding unit, a fixing unit, a discharge tray, and an exposing unit. The process cartridge may include a photosensitive body cartridge and a developing cartridge. The photosensitive body cartridge may include a photosensitive body configured to rotate on an axis. The developing cartridge may include a developing agent carrier configured to supply a developing agent to the photosensitive body. The photosensitive body cartridge may be configured to receive the developing cartridge such that the developing cartridge is attached to the photosensitive body cartridge in a particular direction and detached from the photosensitive body cartridge. The feeding unit may include a feed roller disposed below the process cartridge and a feed tray configured to support one or more recording sheets. The fixing unit may be disposed above the process cartridge. The discharge tray may be configured to support the one or more recoding sheets which have passed the fixing unit. The exposing unit may be disposed between the feed tray and the discharge tray in a vertical direction. The photosensitive body cartridge may include a waste developing agent storage container and a frame. The waste developing agent storage container may extend so as to cover an upper portion of the developing cartridge and may be configured to store therein the developing agent collected from a surface of the photosensitive body. The frame may have a cartridge opening through which the developing cartridge is attached to or detached from the photosensitive body cartridge. The cartridge opening may be defined in a portion upstream of the developing agent carrier in the particular direction. The developing cartridge may be configured to be attached to and detached from the photosensitive body cartridge via the main opening of the main body which is closed and exposed by the discharge tray. The process cartridge may be configured to pivot between a first position and a second position on another axis extending in parallel to the axis. When the process cartridge is located at the first position, the cartridge opening may face the main opening of the main body. When the process cartridge is located at the second position, the exposing unit may be allowed to expose the surface of the photosensitive body via the cartridge opening.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION

Illustrative embodiments will be described with reference to the accompanying drawings. The image forming apparatus according to one of the illustrative embodiments may be implemented by a laser printer 1 depicted in FIGS. 1 and 2. Hereinafter, referring to FIGS. 1 and 2, a general configuration of the laser printer 1 will be described.

Figure 1:
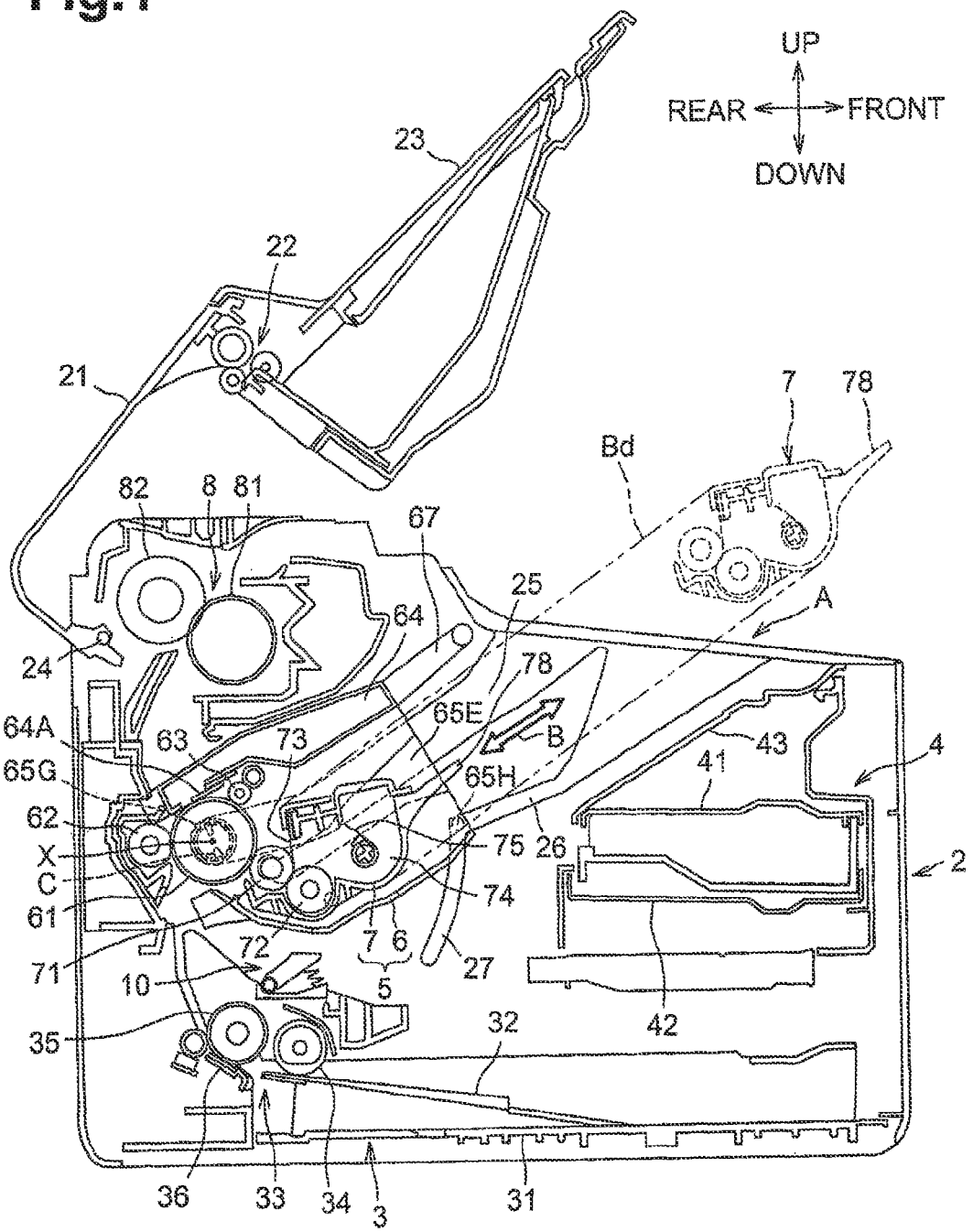
FIG. 1 is a sectional view depicting a general configuration of a laser printer as an example of an image forming apparatus with its top cover opened in an illustrative embodiment according to one or more aspects of the disclosure.

In the description made below referring to FIGS. 1 and 2, with reference to the laser printer 1, directions of up, down, right, left, front, and rear are defined with reference to an orientation of the laser printer 1 that is disposed in which it is intended to be used as depicted in FIG. 1.

<General Configuration of Laser Printer>

Figure 2:
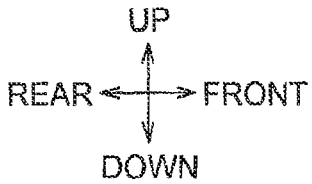
FIG. 2 is a sectional view depicting the general configuration of the laser printer with its top cover closed in the illustrative embodiment according to one or more aspects of the disclosure.
Figure 2:
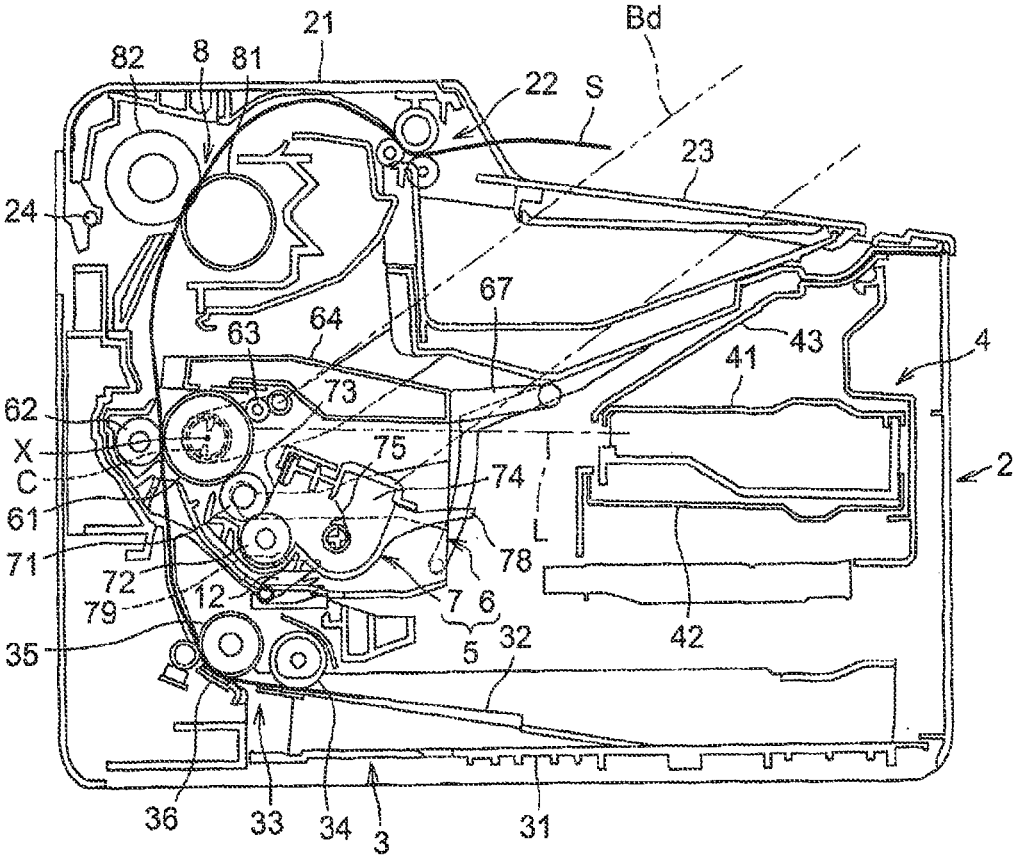

As depicted in FIGS. 1 and 2, the laser printer 1 includes a casing 2 and a top cover 21. The casing 2 is an example of a main body. The top cover 21 is an example of a cover. The casing 2 has an opening A (as an example of a main opening) in its top. The top cover 21 is pivotably supported by an upper rear portion of the casing 2 via a rear end portion of the top cover 21. The top cover 21 is capable of pivoting between an open position at which the top cover 21 opens relative to the top of the casing 2 and exposes the opening A (refer to FIG. 1) and a closed position at which the top cover 21 closes the top of the casing 2 and cover the opening A (refer to FIG. 2).

The laser printer 1 includes a feeding unit 3, a scanner unit 4, a process cartridge 5, a transfer roller 62, and a fixing unit 8 within the casing 2. The feeding unit 3 feeds one or more sheets S (refer to FIG. 2) therefrom. The sheet S is an example of a recording sheet. The scanner unit 4 is an example of an exposing unit. The transfer roller 62 transfers a toner image formed by the process cartridge 5, onto a sheet S. The fixing unit 8 fixes a transferred toner image onto a sheet S by heat.

The feeding unit 3 is disposed in a lower portion of the casing 2. The feeding unit 3 includes a feed tray 31, a sheet pressing plate 32, and a feeding mechanism 33. The feeding mechanism 33 includes a feed roller 34, a separation roller 35, and a separation pad 36.

As depicted in FIG. 2, one or more sheets S supported by the feed tray 31 are moved upward by the sheet pressing plate 32 and are fed curvedly upward, one by one, by the feeding mechanism 33 in a rear portion of the casing 2. The fed sheet S is conveyed to between a photosensitive drum 61 and a transfer roller 62. The photosensitive drum 61 is included in a photosensitive body cartridge 6 constituting the process cartridge 5. The photosensitive drum 61 is an example of a photosensitive body.

The scanner unit 4 is disposed in front half of the casing 2 and in a middle portion of the casing 2 in an up-down direction. In other words, the scanner unit 4 is disposed between the feed tray 31 and a discharge tray 23 in the vertical direction. The scanner unit 4 includes a scanner body 41, a supporting portion 42, and a cover 43. The scanner body 41 includes a laser emitting portion, a polygon mirror, lenses, and reflectors, which are not depicted. The supporting portion 42 supports the scanner body 41. The cover 43 covers an upper portion of the scanner body 41.

In the scanner unit 4, the surface of the photosensitive drum 61 is exposed by high-speed scanning of a laser beam L (refer to FIG. 2) emitted from the laser emitting portion of the scanner body 41 based on image data.

For inserting the process cartridge 5 to the casing 2, the process cartridge 5 is inserted obliquely downward to the rear into the casing 2 via the opening A along an attaching/detaching path B while the top cover 21 is located at the open position to expose the opening A defined in the top of the casing 2 as depicted in FIG. 1. Thus, the process cartridge 5 is positioned behind the scanner unit 4 in the casing 2 (e.g., at an inserted position). For removing the process cartridge 5 from the casing 2, the process cartridge 5 is pulled obliquely upward to the front from the inserted position. Meanwhile, the process cartridge 5 is moved along the attaching/detaching path B and thus removed out of the casing 2 via the opening A.

The process cartridge 5 includes the photosensitive body cartridge 6 and a developing cartridge 7. The photosensitive body cartridge 6 is attachable to and detachable from the casing 2 via the opening A. The developing cartridge 7 is attachable to and detachable from the photosensitive body cartridge 6. The photosensitive body cartridge 6 includes the photosensitive drum 61, a charging roller 63, and a waste toner storage container 64. The photosensitive drum 61 is supplied with toner on its surface from the developing cartridge 7. The toner is an example of a developing agent. The charging roller 63 charges the surface of the photosensitive drum 61 before toner is supplied onto the surface of the photosensitive drum 61. The waste toner storage container 64 collects toner from the surface of the photosensitive drum 61 and stores the collected toner therein. The waste toner storage container 64 is an example of a waste developing agent storage container.

The photosensitive drum 61 includes a drum coupling C. The photosensitive drum 61 is configured to rotate on an axis X in response to receipt of driving force by the drum coupling C from a casing coupling 29 (refer to FIGS. 3 and 4) disposed in the casing 2. The waste toner storage container 64 has a thin box shape extending in a direction that the axis X of the photosensitive drum 61 extends (hereinafter, also referred to as "axial (X) direction"). The waste toner storage container 64 extends so as to cover an upper portion of the developing cartridge 7 when the process cartridge 5 is located at a second position. The waste toner storage container 64 includes a cleaning blade 64A. The cleaning blade 64A is in contact with the surface of the photosensitive drum 61 and collects toner from the surface of the photosensitive drum 61. The waste toner storage container 64 is configured to store therein toner collected from the surface of the photosensitive drum 61 using the cleaning blade 64A. The cleaning blade 64A extends in the axial (X) direction.

The transfer roller 62 is rotatably supported inside the casing 2. The transfer roller 62 transfers a toner image onto a sheet S from the surface of the photosensitive drum 61 while the sheet S passing between the photosensitive drum 61 and the transfer roller 62.

The developing cartridge 7 includes a developing roller 71, a supply roller 72, a layer-thickness regulating blade 73, a toner storage portion 74, and an agitator 75. The developing roller 71 supplies toner onto the surface of the photosensitive drum 61 from the supply roller 72. The developing roller 71 is an example of a developing agent carrier. The supply roller 72 supplies toner onto the surface of the developing roller 71 from the toner storage portion 74. The layer-thickness regulating blade 73 regulates a thickness of a toner layer held by the surface of the developing roller 71 to a certain thickness. The toner layer may be a layer of toner supplied to the surface of the developing roller 71 from the supply roller 72. The toner storage portion 74 stores therein toner to be supplied. The agitator 75 agitates toner stored in the toner storage portion 74.

The developing cartridge 7 having such a configuration is configured to be attached to and detached from the photosensitive body cartridge 6 through a particular space. The particular space is defined in the casing 2. The developing cartridge 7 having such a configuration is configured to be solely removed out of the casing 2 via the opening A by pulling along the attaching/detaching path B. More specifically, the developing cartridge 7 is pulled obliquely upward to the front to detach the developing cartridge 7 from the photosensitive body cartridge 6 and is further moved along the attaching/detaching path B while the top cover 21 is located at the open position (refer to FIG. 1) and exposes the opening A defined in the top of the casing 2. The attaching/detaching path B indicated by a double-headed arrow in FIG. 1 may be a common attaching/detaching path for the process cartridge 5, the photosensitive body cartridge 6, and the developing cartridge 7. An attaching/detaching path Bd indicated by a double-dotted and dashed line in FIG. 2 may be an attaching/detaching path for the developing cartridge 7. The particular space has the attaching/detaching path Bd.

In the process cartridge 5, the charging roller 63 charges the surface of the photosensitive drum 61 uniformly. Then, the surface of the photosensitive drum 61 is exposed by high-speed scanning of a laser beam L emitted from the scanner unit 4, whereby an electrostatic latent image is formed on the surface of the photosensitive drum 61 based on image data. While toner stored in the toner storage portion 74 is agitated by the agitator 75, toner is supplied onto the surface of the supply roller 72 and then further supplied onto the surface of the developing roller 71. Then, toner passes between the surface of the developing roller 71 and the layer-thickness regulating blade 73 and becomes a thin toner layer on the surface of the developing roller 71.

Toner carried by the surface of the developing roller 71 is further supplied onto the electrostatic latent image formed on the surface of the photosensitive drum 61 from the surface of the developing roller 71. Thus, the electrostatic latent image becomes visualized and a toner image is formed on the surface of the photosensitive drum 61. Then, while a sheet P passes between the photosensitive drum 61 and the transfer roller 62, the toner image is transferred onto the sheet S from the surface of the photosensitive drum 61.

Thereafter, the sheet S having the toner image transferred from the surface of the photosensitive drum 61 is further conveyed to the fixing unit 8 while the sheet S passes between the photosensitive drum 61 and the transfer roller 62. The fixing unit 8 is disposed above the process cartridge 5. The fixing unit 8 includes a heating roller 81 and a pressing roller 82 that convey the sheet S by pinching the sheet S therebetween. While the heating roller 81 and the pressing roller 82 pinch the sheet S therebetween, the pressing roller 82 applies pressure to the sheet S and the heating roller 81 applies heat to the sheet S using a heat source, such as a built-in halogen lamp.

While the sheet S passes between the heating roller 81 and the pressing roller 82 of the fixing unit 8, the toner image transferred onto the sheet S is fixed by heat. The sheet S having the toner image fixed thereon by heat is further conveyed frontward from an upper rear portion of the casing 2 by the heating roller 81 and the pressing roller 82 while the sheet S is warped toward the front. Then, the sheet S is discharged onto a discharge tray 23 by discharge rollers 22. The discharge tray 23 is defined at the top of the top cover 21.

In such a laser printer 1, the feeding unit 3 is disposed below the process cartridge 5, and the fixing unit 8 and the discharge tray 23 are disposed above the process cartridge 5. The laser printer 1 has a first conveying path and a second conveying path. The first conveying path guides a sheet S fed from the feed tray 31 curvedly upward at a rear portion of the laser printer 1 and further guides the sheet S toward the photosensitive drum 61 at the time of conveying the sheet S. The second conveying path bends the sheet S, which has passed the photosensitive drum 61, toward the front and further guides the sheet S to the discharge tray 23 at the time of conveying the sheet S. As described above, the first conveying path and the second conveying path forms a C-shaped conveying route within the casing 2.

<Configuration of Guides in Process Cartridge>

As depicted in FIGS. 1, 2, 3, and 4, the casing 2 includes first guides 25 and third guides 26 (for convenience in drawing, only one of the first guides 25 and one of the third guides 26 are depicted in FIGS. 1, 2, 3, and 4). Each of the first guides 25 extends obliquely downward to the rear from a generally rear half section of the opening A. Each of the third guides 26 extends obliquely downward to the rear from a generally front half section of the opening A. The first guides 25 and the third guides 26 may be grooves. One of the first guides 25 and one of the third guides 26 are defined in an inner surface of one of sidewalls (e.g., right and left sidewalls) of the casing 2 and the other of the first guides 25 and the other of the third guides 26 are defined in an inner surface of the other of the sidewalls of the casing 2.

The first guides 25 and the third guides 26 guide the process cartridge 5 for moving obliquely downward to the rear from the opening A (depicted in FIG. 1) toward a first position at the time of attaching the process cartridge 5 to the casing 2.

The first guides 25 and the third guides 26 also guide the process cartridge 5 for moving obliquely upward to the front from the first position toward the opening A at the time of detaching the process cartridge 5 from the casing 2 via the opening A.

The process cartridge 5 includes first guided portions 65G at respective ends in the axial (X) direction. When the process cartridge 5 is located at the first position, each of the first guided portion 65G is located at a most downstream portion of a corresponding one of the first guides 25 in an attaching direction (as an example of a particular direction) of the process cartridge 5 to the casing 2. The casing 2 includes the casing coupling 29 configured to transmit driving force to the photosensitive drum 61 of the process cartridge 5 located at the first position. The casing coupling 29 is disposed so as to face the drum coupling C of the photosensitive drum 61 in the axial (X) direction when the process cartridge 5 is located at the first position. The direction that the common attaching/detaching path B for the process cartridge 5 and the photosensitive body cartridge 6 with respect to the casing 2 may extend in a direction substantially the same as a direction that the first guides 25 and the third guides 26 extend.

Each of the first guides 25 has a relatively wide width throughout (e.g., from a front portion to a rear portion). Each of the third guides 26 extends obliquely downward toward the rear and has a funnel shape so as to be tapered toward the bottom from the top. Lower rear portions of the third guides 26 have a width narrower than the width of any portions of the first guides 25.

Figure 3:
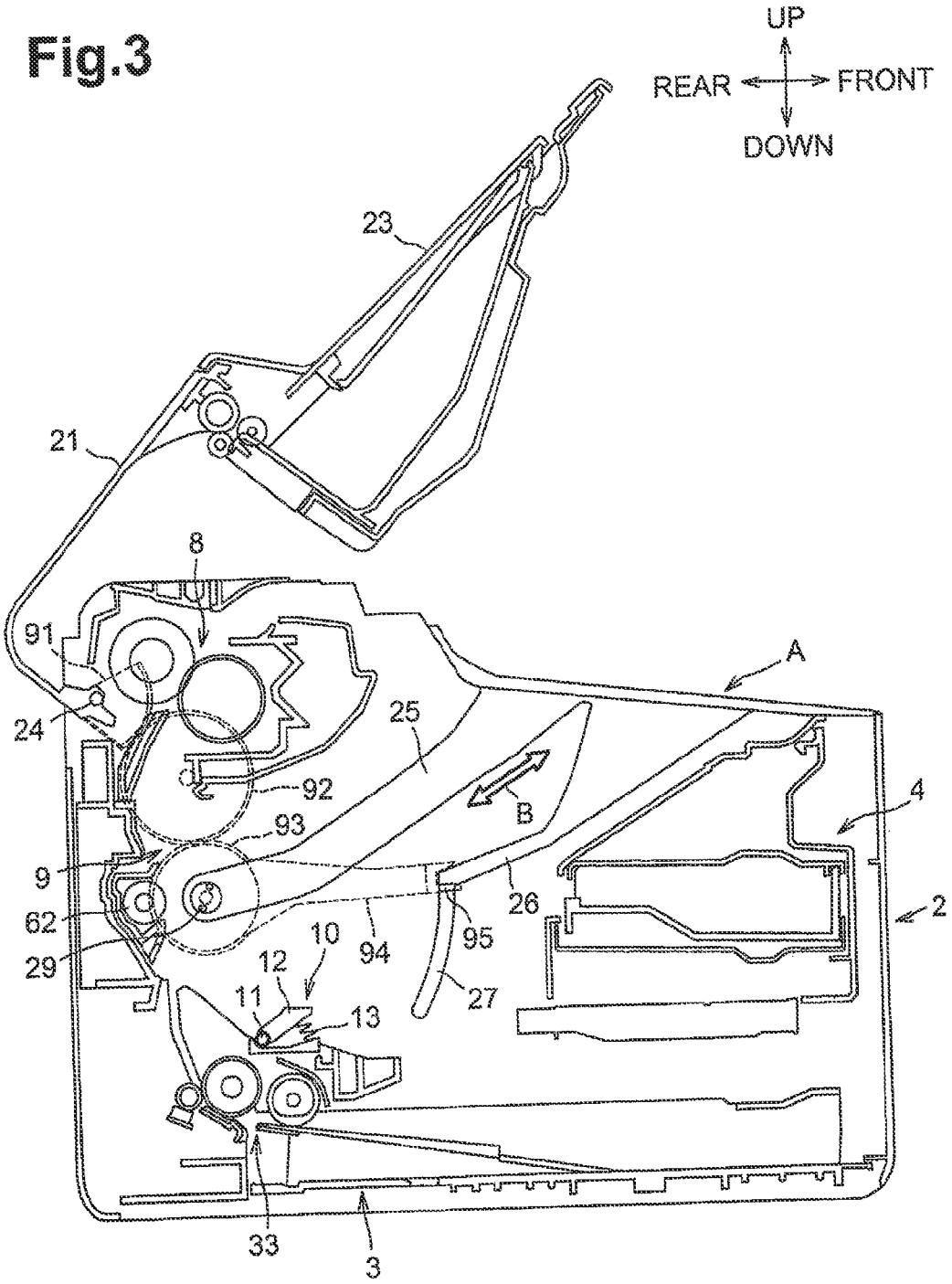
FIG. 3 is a sectional view depicting the laser printer with its top cover opened in the illustrative embodiment according to one or more aspects of the disclosure, wherein a process cartridge is not positioned inside the laser printer.
Figure 4:
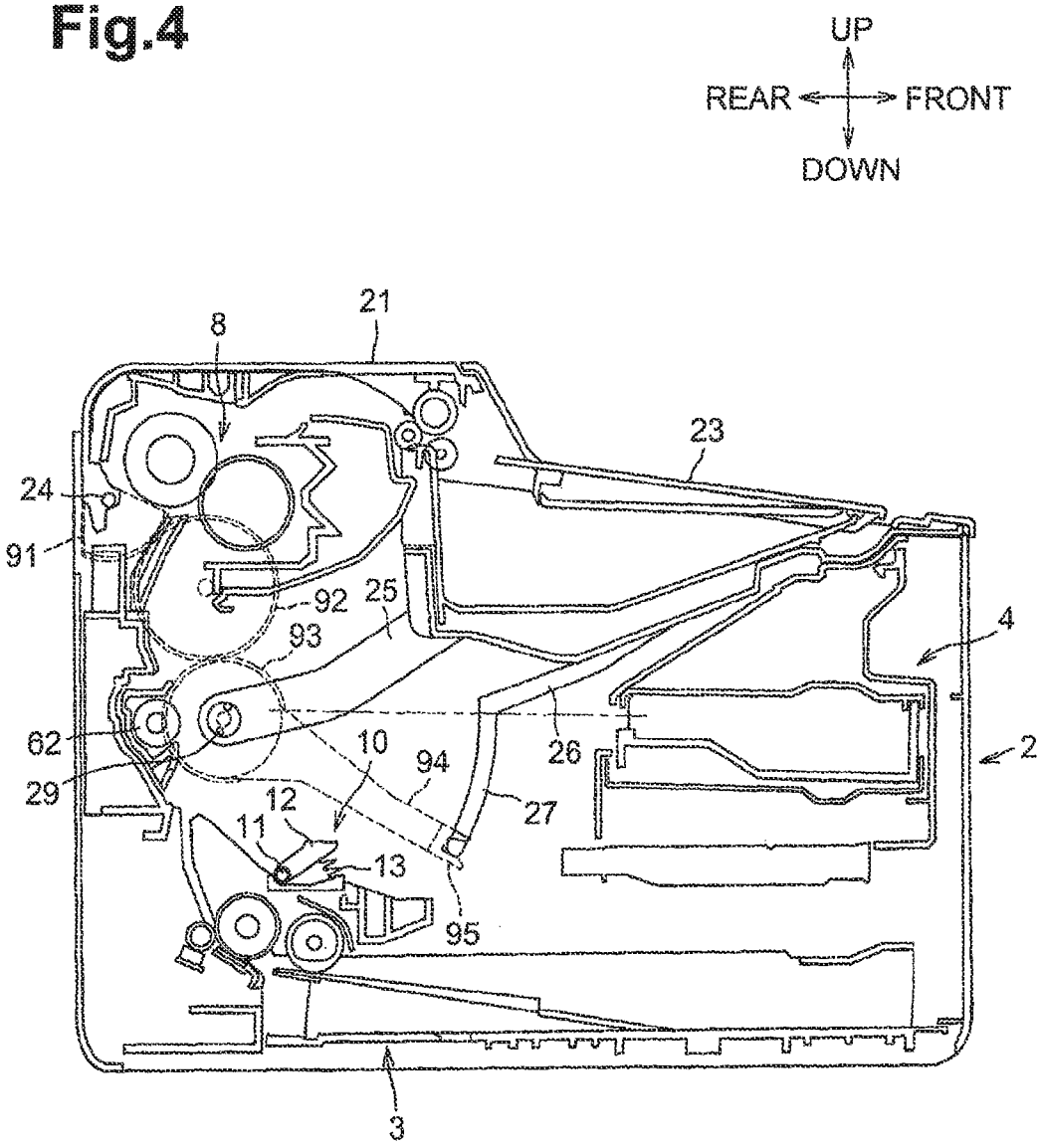
FIG. 4 is a sectional view depicting the laser printer with its top cover closed in the illustrative embodiment according to one or more aspects of the disclosure, wherein the process cartridge is not positioned inside the laser printer.

The casing 2 further includes arc-shaped second guides 27 for guiding a movement of the process cartridge 5 at the time of pivoting the process cartridge 5 between the first position (refer to FIG. 1) and the second position (refer to FIG. 2) (for convenience in drawing, only one of the second guides 27 is depicted in FIGS. 1, 2, 3, and 4). One of the second guides 27 is defined in the inner surface of the one of the sidewalls of the casing 2 and the other of the second guides 28 is defined in the inner surface of the other of the sidewalls of the casing 2. As depicted in FIGS. 3 and 4, each of the second guides 27 has a relatively narrow width and extends downward from a rear end of a corresponding one of the third guides 26.

Each of the second guides 27 has an arc shape which is a portion of a circle having the center through which the axis X of the photosensitive drum 61 passes. The photosensitive body cartridge 6 includes second guided portions 65H at respective ends in the axial (X) direction. When the photosensitive body cartridge 6 is located at the second position, each of the second guided portions 65H of the photosensitive body cartridge 6 is located at a lower end portion of a corresponding one of the second guides 27. The scanner unit 4 exposes the surface of the photosensitive drum 61 by emitting a laser beam L such that the laser beam L travels in a space between the waste toner storage container 64 and the developing cartridge 7 when the process cartridge 5 is located at the second position.

<Configuration of Interlocking Mechanism>

An interlocking gear mechanism 9 is disposed within the casing 2 as depicted in FIGS. 3 and 4. The interlocking gear mechanism 9 functions as an interlocking mechanism for pivoting the process cartridge 5 between the first position (refer to FIG. 1) and the second position (refer to FIG. 2) in response to opening or closing of the top cover 21.

The interlocking gear mechanism 9 includes a sector gear 91, an intermediate gear 92, a partially toothed gear 93, and a fork arm 94 at each side inside the casing 2 in a right-left direction. The same components have the same configuration and features, and therefore, a description will be made on one of the same components. The sector gear 91 is a driving gear and is integrally disposed at a rear end portion of the top cover 21. The intermediate gear 92 is rotatably supported by the casing 2 in mesh with the sector gear 91. The partially toothed gear 93 is a driven gear and is rotatably supported by the casing 2 in mesh with the intermediate gear 92. The fork arm 94 is integral with the partially toothed gear 93 and extends from a missing tooth portion of the partially toothed gear 93. The fork arm 94 includes a two-pronged fork portion 95 at its distal end.

When the top cover 21 is located at the open position (refer to FIG. 3), the interlocking gear mechanism 9 enables the fork arm 94 to extend frontward in substantially the horizontal direction such that the fork portion 95 of the fork arm 94 is positioned at an upper end portion of the arc-shaped second guide 27. In response to pivoting of the top cover 21 on a pivot 24 to the closed position (refer to FIG. 4), the sector gear 91 rotate along with the top cover 21 on the pivot 24, whereby the fork arm 94 pivots downward so as to extend obliquely downward to the front. Meanwhile, the fork portion 95, which is the distal end portion of the fork arm 94, moves to the lower end portion of the second guide 27 along the arc-shaped second guide 27.

<Detailed Configuration of Photosensitive Body Cartridge>

Figure 5:
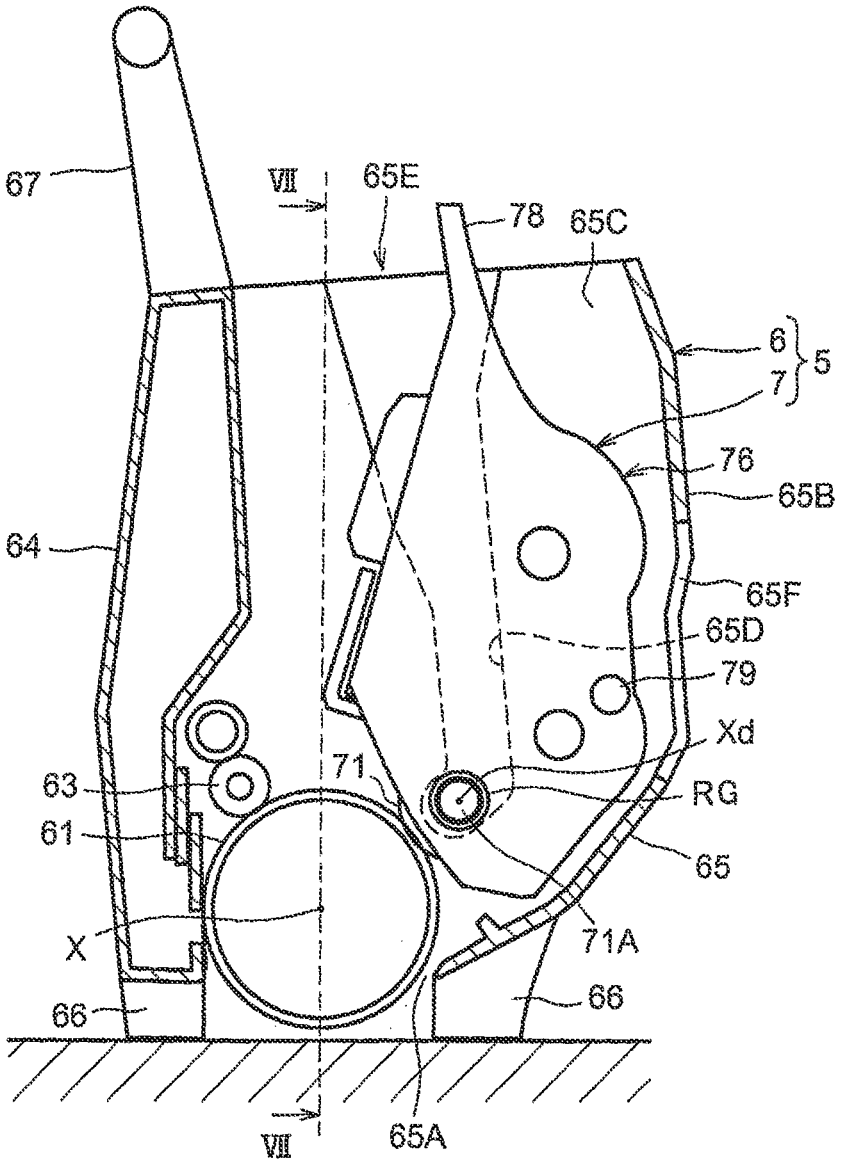
FIG. 5 is a sectional view intersecting with an axial direction of a photosensitive drum, depicting the process cartridge that is removed from the laser printer and stands with foot portions in the illustrative embodiment according to one or more aspects of the disclosure.
Figure 7:
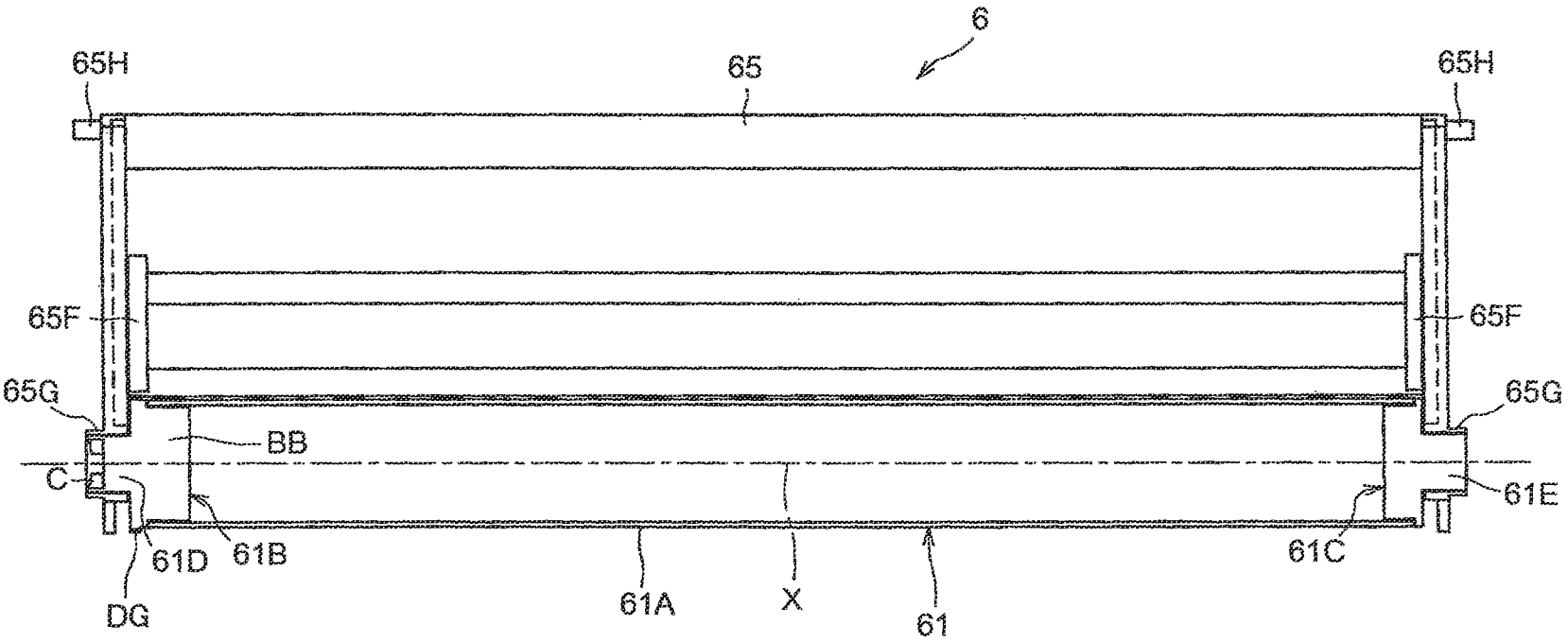
FIG. 7 is a sectional view taken along line VII-VII of FIG. 5 in the illustrative embodiment according to one or more aspects of the disclosure.

As depicted in FIG. 5, the photosensitive body cartridge 6 includes the photosensitive drum 61, a frame 65, and foot portions 66. The frame 65 supports the photosensitive drum 61 so as to be rotatable. As depicted in FIG. 7, the photosensitive drum 61 includes a drum body 61A, a first flange 61B, and a second flange 61C.

The first flange 61B is fixedly attached to one end of the drum body 61A in the axial (X) direction and the second flange 61C is fixedly attached to the other end of the drum body 61A in the axial (X) direction. The first flange 61B and the second flange 61C rotate integrally with the drum body 61A on the axis X. The first flange 61B includes a shaft portion 61D and the second flange 61C includes a shaft portion 61E.

As depicted in FIG. 7, the first flange 61B includes the shaft portion 61D, a body portion BB, the drum coupling C, and a drum gear DG. The body portion BB has a diameter larger than the shaft portion 61D and is positioned inside the drum body 61A. The drum coupling C is configured to engage the casing coupling 29 to drive the photosensitive drum 61. The drum coupling C is disposed at a distal end portion of the shaft portion 61D. The drum coupling C includes a plurality of, for example, two, protrusions facing across the axis X. The drum gear DG is provided at a portion of a peripheral surface of the body portion BB closer to the shaft portion 61D. The drum gear DG transmits driving force, which is inputted into the first flange 61B from the casing coupling 29 via the drum coupling C, to the developing roller 71 and the charging roller 63.

As depicted in FIG. 5, the frame 65 has an opening 65A for exposing a portion of the surface of the photosensitive drum 61. The opening 65A may be a long narrow opening extending along the axis X of the photosensitive drum 61 in the frame 65. The foot portions 66 protrude relative to one (e.g., a lower surface when the process cartridge 5 stands vertically) of peripheral surfaces of the photosensitive drum 61. The foot portions 66 are disposed facing across the opening 65A. The foot portions 66 enable the process cartridge 5 to stand vertically while the photosensitive drum 61 is positioned at a lower portion of the frame 65 as depicted in FIG. 5 after the process cartridge 5 is removed out of the casing 2 via the opening A along the attaching/detaching path B of FIG. 1.

The frame 65 of the photosensitive body cartridge 6 includes a lower wall 65B, sidewalls 65C, and attachment/detachment guides 65D. The lower wall 65B extends along the axial (X) direction while facing the waste toner storage container 64. The sidewalls 65C connect the waste toner storage container 64 and the lower wall 65B to each other near the end portions of the photosensitive drum 61. The attachment/detachment guides 65D are defined in the respective sidewalls 65C. The photosensitive body cartridge 6 accommodates the developing cartridge 7 in a space defined therein by the waste toner storage container 64, the lower wall 65B, and the sidewalls 65C. In a state where the process cartridge 5 is located at the second position (refer to FIG. 2) while the developing cartridge 7 is positioned (e.g., accommodated) within the photosensitive body cartridge 6, the lower wall 65B is positioned opposite to the waste toner storage container 64 across the developing cartridge 7 in the vertical direction. The photosensitive drum cartridge 6 has an opening 65E (as an example of a cartridge opening). The opening 65E is defined by a front edge of the waste toner storage container 64, a front edge of the lower wall 65B, and front edges of the sidewalls 65C. The opening 65E is an example of attachment/detachment opening. The developing cartridge 7 is attached to or detached from the photosensitive body cartridge 6 via the opening 65E. The opening 65E is defined in a position opposite to the photosensitive drum 61 across the developing cartridge 7 in a front-rear direction.

Figure 6A:
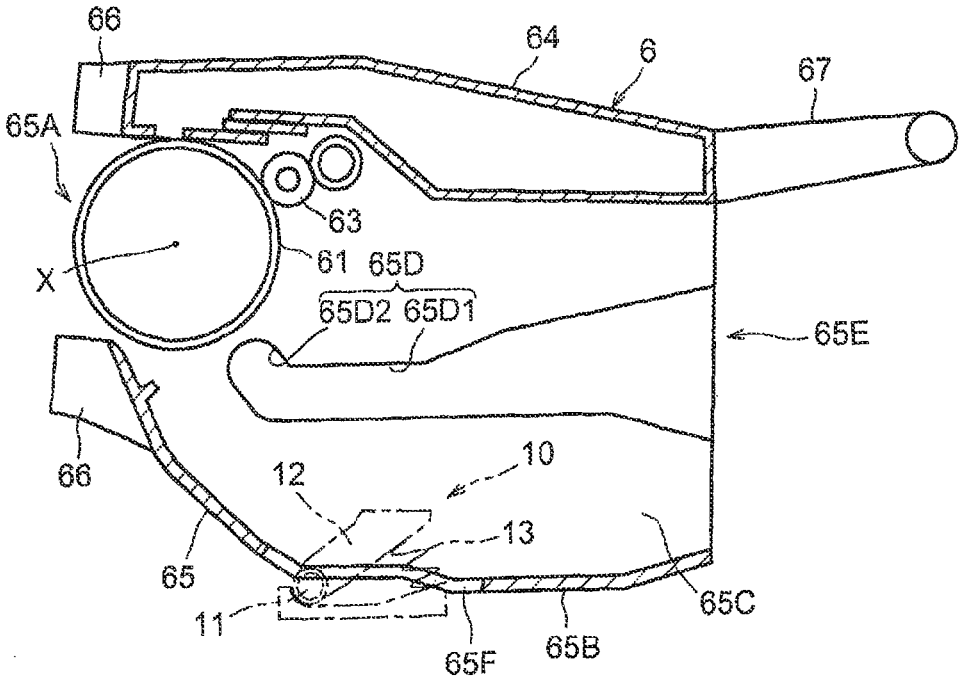
FIG. 6A is a sectional view intersecting with the axial direction, depicting a configuration of a photosensitive body cartridge constituting the process cartridge of FIG. 5 in the illustrative embodiment according to one or more aspects of the disclosure

The attachment/detachment guides 65D guide respective end portions of a shaft 71A of the developing roller 71 of the developing cartridge 7 at the time of attaching or detaching the developing cartridge 7 with respect to the photosensitive body cartridge 6. The attachment/detachment guides 65D are defined in the inner surfaces of the respective sidewalls 65C (for convenience in drawing, only one of the attachment/detachment guides 65D is depicted in FIG. 6A.). Each of the attachment/detachment guides 65D includes a first portion 65D1 and a second portion 65D2. The first portion 65D 1 extends in the front-rear direction when the process cartridge 5 is located at the second position. The second portion 65D2 extends obliquely upward toward the rear from the first portion 65D1 when the process cartridge 5 is located at the second position.

The direction that second portion 65D2 extends when the process cartridge 5 is located at the second position is substantially the same as a direction that pressing portions 10 press the developing cartridge 7 toward the photosensitive drum 61. The direction that the first portion 65D1 extends when the process cartridge 5 is located at the first position is substantially the same as a direction that the first guides 25 and the third guides 26 extend.

The lower wall 65B of the frame 65 has slits 65F that allow the respective pressing portions 10 (only one of the pressing portions 10 is depicted in FIG. 6A) to pass through the lower wall 65B. As depicted in FIG. 7, the slits 65F are defined at respective end portions of the frame 65 in a direction that longer sides of the frame 65 extend (hereinafter, referred to as "elongated direction of the frame 65").

The waste toner storage container 64 includes a handle 67 used for attaching and detaching the photosensitive body cartridge 6 alone or the process cartridge 5 with respect to the casing 2. The handle 67 extends from one of ends of the waste toner storage container 64, which is the end disposed on the same side as the end of the frame 65 in which the opening 65E is defined. In a state where the process cartridge 5 is located at the first position (refer to FIG. 1) and the top cover 21 is located at the open position (refer to FIG. 1), the handle 67 extends from the waste toner storage container 64 toward the opening A of the casing 2. In a state where the process cartridge 5 is located at the second position (refer to FIG. 2) and the top cover 21 is located at the closed position (refer to FIG. 2), the handle 67 is positioned closer to the opening A (refer to FIG. 1) of the casing 2 than an optical path of a laser beam L.

Figure 6B:
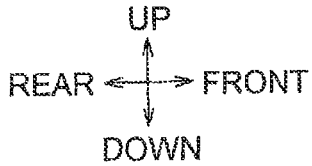
FIG. 6B is a side view intersecting with the axial direction, depicting the photosensitive body cartridge in the illustrative embodiment according to one or more aspects of the disclosure.
Figure 6B:
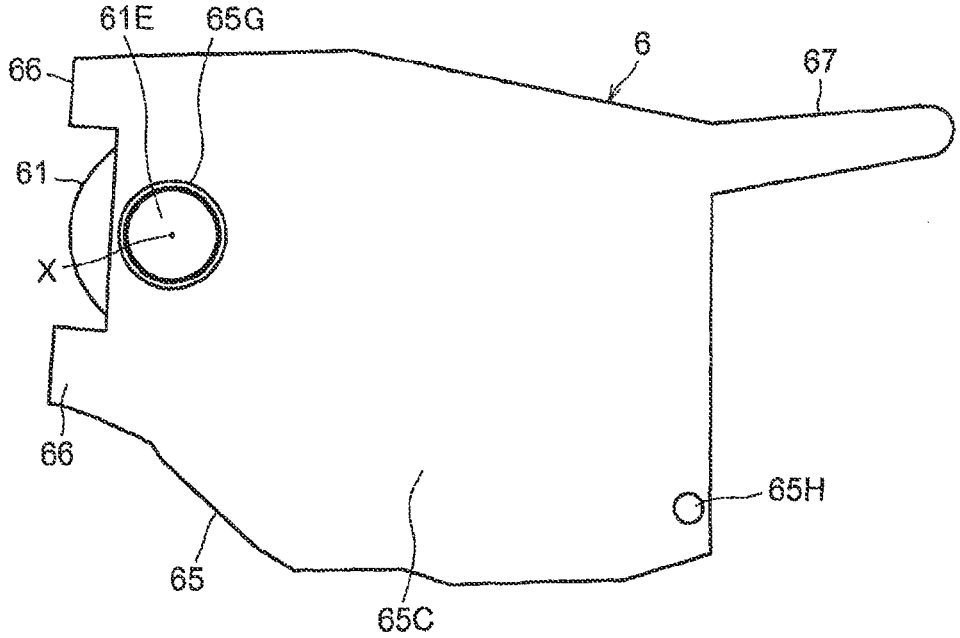

As depicted in FIGS. 6B and 7, each of the sidewalls 65C, which define respective ends of the frame 65 in the elongated direction of the frame 65, includes a first guided portion 65G and a second guided portion 65H. One of the first guided portions 65G protrudes from an outer surface of one of the sidewalls 65C along the axial (X) direction, and the other of the first guided portions 65G protrudes from an outer surface of the other of the sidewalls 65C along the axial (X) direction. As depicted in FIG. 7, the shaft portion 61D of the first flange 61B and the shaft portion 61E of the second flange 61C, which are disposed at the respective ends of the photosensitive drum 61 in the axial (X) direction, are in engagement with the corresponding first guided portions 65G so as to be rotatable. Each of the first guided portions 65G may be a hollow cylindrical protrusion having the axis X of the photosensitive drum 61 as its center. As depicted in FIGS. 1 and 3, the first guided portions 65G are guided along the respective first guides 25 at the time of attaching or detaching the photosensitive drum 6 alone or the process cartridge 5 with respect to the casing 2.

As depicted in FIG. 7, one of the second guided portions 65H protrudes from an outer surface of the one of the sidewalls 65C along the axial (X) direction and the other of the second guided portions 65H protrudes from the outer surface of the other of the sidewalls 65C along the axial (X) direction. As depicted in FIG. 6B, each of the second guided portions 65H is disposed at a lower end portion of the corresponding one of the sidewalls 65C of the frame 65 closer to the handle 67. As depicted in FIGS. 1 and 3, each of the second guided portion 65H is guided along a corresponding one of the third guides 26 and a corresponding one of the second guides 27 at the time of attaching or detaching the photosensitive body cartridge 6 alone or the process cartridge 5 with respect to the casing 2.

<Detailed Configuration of Pressing Portions>

Each of the pressing portions 10 includes a support pin 11, a pivot lever 12, and a spring member 13 (only one of the pressing portions 10 is depicted in FIG. 6A) Both of the pressing portions 10 have the same configuration and features, and therefore, a description will be made on one of the pressing portions 10. The support pin 11 extends along the axial (X) direction. The pivot lever 12 is supported so as to be pivotable on the support pin 11. The spring member 13 urges counterclockwise the pivot lever 12 of which distal end directs obliquely upward toward the front. The pressing portions 10 press the developing cartridge 7 toward the photosensitive drum 61. As depicted in FIGS. 1 and 3, the pressing portions 10 are disposed within the casing 2 and above the feeding mechanism 33 of the feeding unit 3.

<Detailed Configuration of Developing Cartridge>

Figure 8:
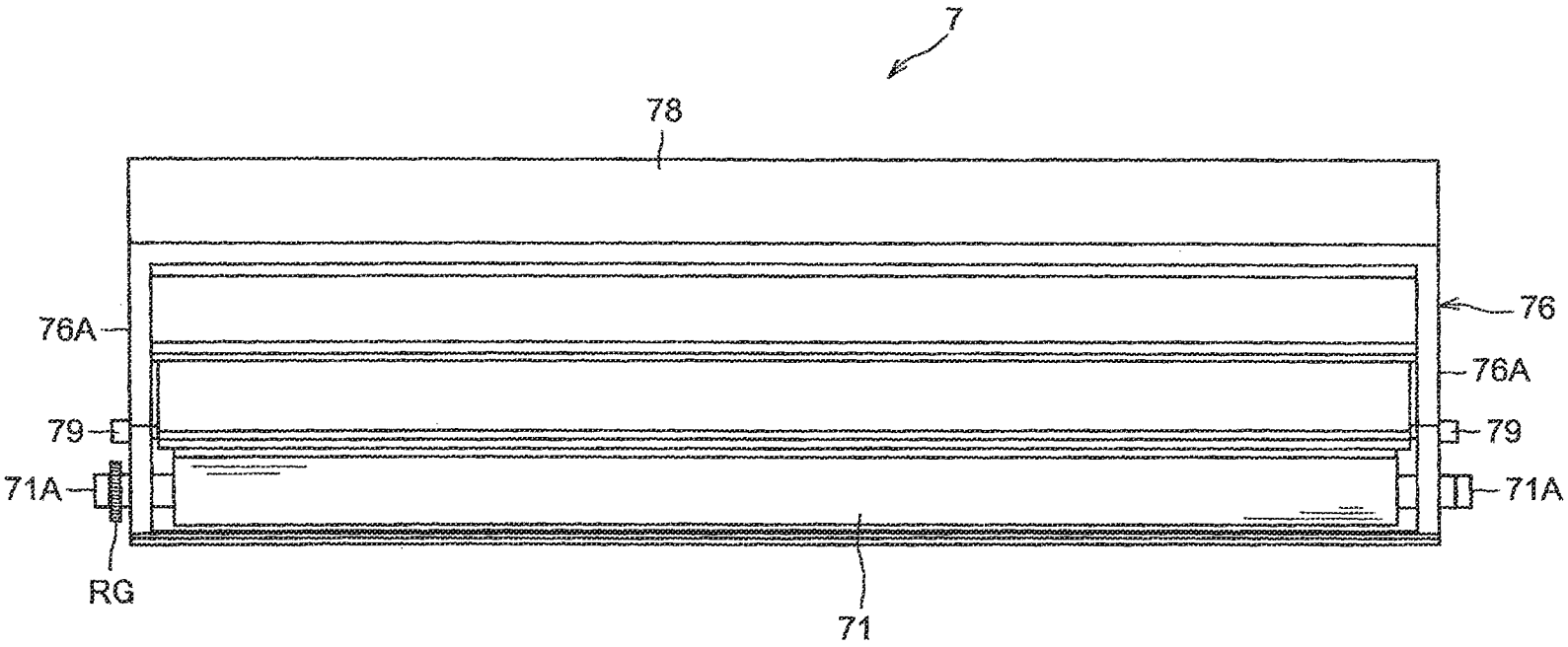
FIG. 8 is a plan view depicting a configuration of the developing cartridge depicted in FIG. 1 in the illustrative embodiment according to one or more aspects of the disclosure.

As depicted in FIG. 5, the developing cartridge 7 includes a frame 76 and a developing roller gear RG. The frame 76 of the developing cartridge 7 may be a casing extending in a direction that an axis Xd of the developing roller 71 extends (hereinafter, also referred to as "axial (Xd) direction"). The frame 76 of the developing cartridge 7 includes a handle 78 protruding relative to the opening 65E of the frame 65 of the photosensitive body cartridge 6 in a state where the developing cartridge 7 is joined to the photosensitive body cartridge 6. The handle 78 is used at the time of attaching or detaching the developing cartridge 7 with respect to the photosensitive body cartridge 6. The frame 76 of the developing cartridge 7 further includes auxiliary pressing portions 79. The auxiliary pressing portions 79 press the developing roller 71 against the photosensitive drum 61 of the photosensitive body cartridge 6. As depicted in FIG. 8, the auxiliary pressing portions 79 protrude from outer surfaces of respective sidewalls 76A of the frame 76 of the developing cartridge 7 along the axial (Xd) direction. The auxiliary pressing portions 79 have a circular shape in cross section.

The developing roller 71 includes a shaft 71A that extends along the axial (Xd) direction while having the axis Xd as its center. End portions of the shaft 71A in the axial (Xd) direction protrude beyond the frame 76 of the developing cartridge 7. The developing roller gear RG is fixed to one of the end portions of the shaft 71A. The developing roller gear RG is configured to mesh with the drum gear DG in a state where the developing cartridge 7 is joined to the photosensitive body cartridge 6. The developing roller gear RG rotates the developing roller 71 upon receipt of driving force from the drum gear DG. The supply roller 72 and the agitator 75 are configured to rotate by input of driving force into the developing roller gear RG.

The auxiliary pressing portions 79 are disposed so as to come into engagement with the pivot levers 12 of the respective pressing portions 10 that are configured to enter the respective slits 65F of the frame 65 as depicted in FIG. 6A. As depicted in FIG. 2, the auxiliary pressing portions 79 are pressed obliquely upward toward the rear while being in engagement with the respective pivot levers 12, thereby pressing the developing roller 71 against the photosensitive drum 61.

In the laser printer 1 having the above-described configuration, when the top cover 21 is located at the open position where the top cover 21 exposes the opening A of the casing 2 (refer to FIG. 3), the fork portion 95 of each of the fork arms 94 constituting the interlocking gear mechanism 9 is located at the upper end portion of the corresponding second guide 27 defined in one of the inner surfaces of the sidewalls of the casing 2. In this state, the photosensitive body cartridge 6 of the process cartridge 5 is inserted into the casing 2 obliquely downward toward the rear along the attaching/detaching path B via the opening A of the casing 2. During the insertion of the photosensitive body cartridge 6, the first guided portions 65G (refer to FIG. 6B) of the photosensitive body cartridge 6 are guided by the respective first guides 25 defined in the inner surfaces of the respective sidewalls of the casing 2 and the second guided portions 65H (refer to FIG. 6B) of the photosensitive body cartridge 6 are guided by the respective third guide 26 defined in the inner surfaces of the respective sidewalls of the casing 2. Thus, the process cartridge 5 is moved to the first position (refer to FIG. 1) smoothly.

When the process cartridge 5 is located at the first position (refer to FIG. 1), the waste toner storage container 64 of the photosensitive body cartridge 6 is positioned out of the attaching/detaching path Bd for the developing cartridge 7 (e.g., above the attaching/detaching path Bd) and the opening 65E of the photosensitive body cartridge 6 is positioned on the attaching/detaching path Bd. In other words, the opening 65E faces the opening A of the casing 2. Therefore, when the process cartridge 5 is located at the first position (refer to FIG. 1), the developing cartridge 7 may be detached from the casing 2 via the opening A along the attaching/detaching path Bd smoothly. When the process cartridge 5 is located at the first position (refer to FIG. 1), the developing cartridge 7 is positioned so as to obstruct a laser beam L emitted from the scanner body 41 of the scanner unit 4 and the waste toner storage container 64 traverses a portion of the conveying path extending from the photosensitive drum 61 to the fixing unit 8.

When the process cartridge 5 is located at the first position (refer to FIG. 1), the fork portion 95 of each of the fork arms 94 of the interlocking gear mechanism 9 is positioned at the upper end portion of the corresponding second guide 27 of the casing 2 and each of the second guided portion 65H of the photosensitive body cartridge 6 is in engagement with a recessed portion of a corresponding one of the fork portions 95. Under this state, the top cover 21 is pivoted to the closed position (refer to FIG. 2). In response to this, each fork portion 95 that is in engagement with the corresponding one of the second guided portions 65H of the photosensitive body cartridge 6 moves to the lower end portion of the corresponding one of the second guides 27 along the curve of the second guide 27, and the process cartridge 5 pivots on the axis X of the photosensitive drum 61 extending the centers of the shaft portions 61D and 61E that are rotatably in engagement with the respective first guided portions 65G of the photosensitive body cartridge 6. Thus, the process cartridge 5 is located at the second position (refer to FIG. 2).

As described above, when the process cartridge 5 is located at the second position (refer to FIG. 2), the waste toner storage container 64 of the photosensitive body cartridge 6 is positioned above the attaching/detaching path Bd for the developing cartridge 7 and the opening 65E of the photosensitive body cartridge 6 is not positioned on the attaching/detaching path Bd. Under this situation, the waste toner storage container 64 of the photosensitive body cartridge 6 and the developing cartridge 7 are located at respective positions such that the waste toner storage container 64 and the developing cartridge 7 allow a laser beam L emitted from the scanner body 41 of the scanner unit 4 to travel in the space therebetween toward the photosensitive drum 61. In other words, when the process cartridge 5 is located at the second position, the scanner unit 4 is able to expose the surface of the photosensitive drum 61 via the opening 65E of the photosensitive body cartridge 6. Thus, the process cartridge 5 becomes enabled to transfer a toner image onto a sheet S.

That is, according to the illustrative embodiment, in the laser printer 1, the process cartridge 5 is supported by the casing 2 so as to be pivotable between the first position and the second position along with the waste toner storage container 64 of the photosensitive body cartridge 6. When the process cartridge 5 is located at the first position, the waste toner storage container 64 of photosensitive body cartridge 6 is positioned out of the attaching/detaching path Bd for the developing cartridge 7. Therefore, the waste toner storage container 64 may be positioned without obstructing the attachment and detachment of the developing cartridge 7.

The description has been made as to the laser printer 1 as the example of the image forming apparatus according to the illustrative embodiment. Nevertheless, the image forming apparatus is not limited to the laser printer 1 according to the illustrative embodiment, and the configuration of the laser printer 1 may be changed or modified appropriately. For example, in other embodiments, the process cartridge 5 may include a photosensitive body unit that may be configured not to be attached to and detached from the casing 2 easily.

Figure 9:
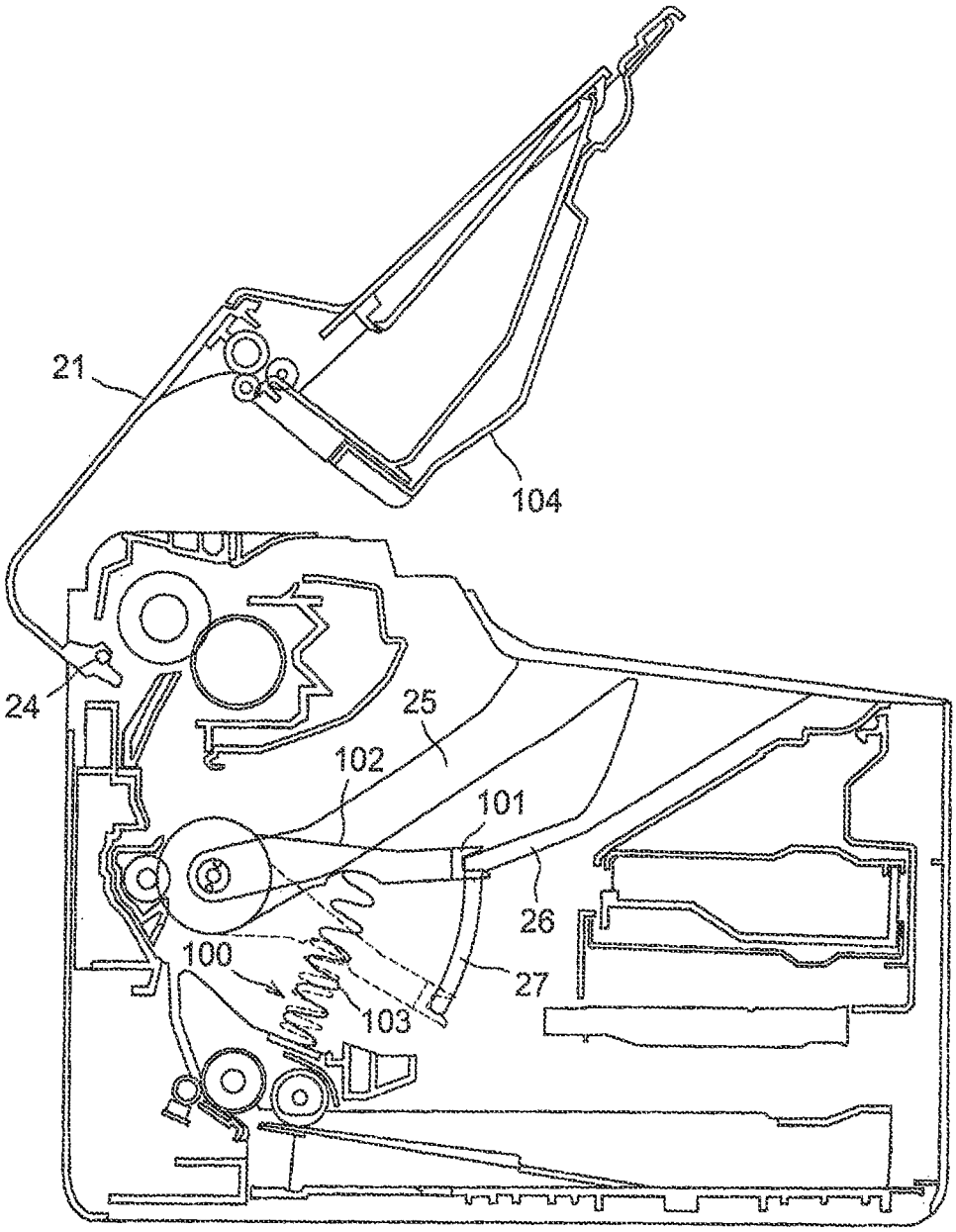
FIG. 9 is a sectional view of the laser printer including an interlocking mechanism in a variation of the illustrative embodiment according to one or more aspects of the disclosure.

In other embodiments, for example, an interlocking mechanism 100 depicted in FIG. 9 may be adopted for pivoting the process cartridge 5 between the first position (refer to FIG. 1) and the second position (refer to FIG. 2) in response to opening or closing of the top cover 21.

As depicted in FIG. 9, the interlocking mechanism 100 includes a fork arm 102 and a pressure spring 103 at each side inside the casing 2 in the right-left direction, as a mechanism for urging the process cartridge 5 to the first position (refer to FIG. 1). The same components have the same configuration and features, and therefore, a description will be made on one of the same components. The fork arm 102 includes a fork portion 101 at its distal end similar to the fork portion 95 depicted in FIG. 3. The pressure spring 103 urges the fork arm 102 upward such that the fork portion 101 is retained at the upper end portion of the second guide 27. The top cover 21 includes an inclined pressing surface 104 at its inner surface. The inclined pressing surface 104 functions as a mechanism for pressing the process cartridge 5 to the second position (refer to FIG. 2) and is engageable with the tip end of the handle 67 of the photosensitive body cartridge 6 of FIG. 1.

According to the interlocking mechanism 100, in response to pivoting of the top cover 21 to the closed position, the inclined pressing surface 104 of the top cover 21 presses the distal end portion of the handle 67 of the photosensitive body cartridge 6 (refer to FIG. 1) downward on the route to the closed position. With this pressing by the inclined pressing surface 104, the process cartridge 5 is pressed downward to the second position (refer to FIG. 2). In response to pivoting of the top cover 21 to the open position, each of the fork arm 102 pivots upward by upward urging force from the corresponding one of the pressure springs 103 and thus each of the fork portions 101 of the form arms 102 is located at the upper end portion of the corresponding one of the second guides 27. In response to this, the process cartridge 5 pivots to the first position (refer to FIG. 1) while the second guided portions 65H of the photosensitive body cartridge 6 engaged in the respective fork portions 101 move upward to the upper end portions of the respective second guides 27.

Figure 10A:
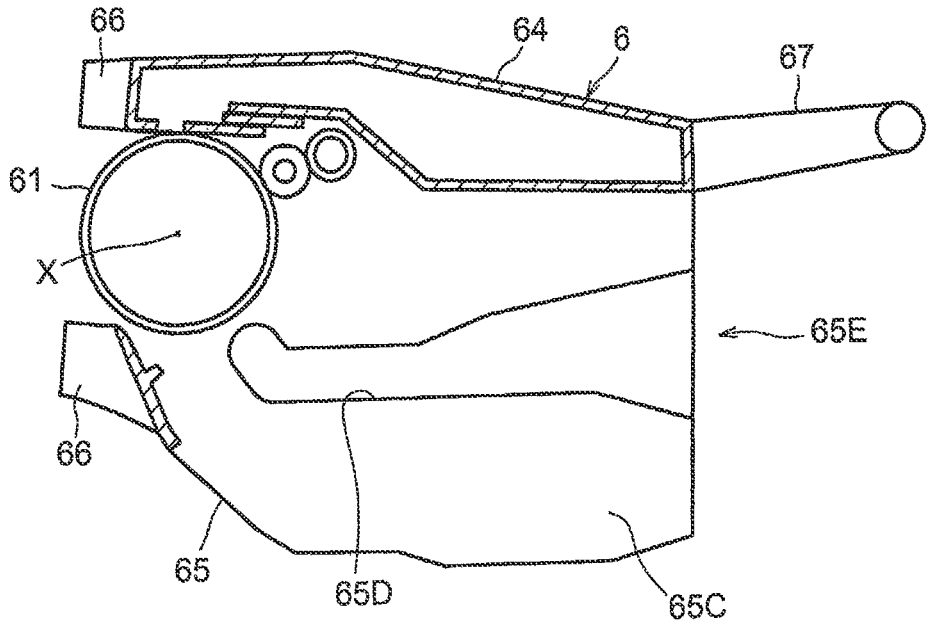
FIG. 10A is a sectional view intersecting with the axial direction, depicting a photosensitive body cartridge in a first variation of the illustrative embodiment according to one or more aspects of the disclosure.

In other embodiments, for example, as depicted in FIG. 10A, the frame 65 of the photosensitive body cartridge 6 may have no lower wall and a lower portion of the frame 65 may be opened. In this case, the developing cartridge 7 may be attached to and detached from the photosensitive body cartridge 6 via the opening 65E that is defined by the front edges of the sidewalls 65C and the front edge of the waste toner storage container 64.

Figure 10B:
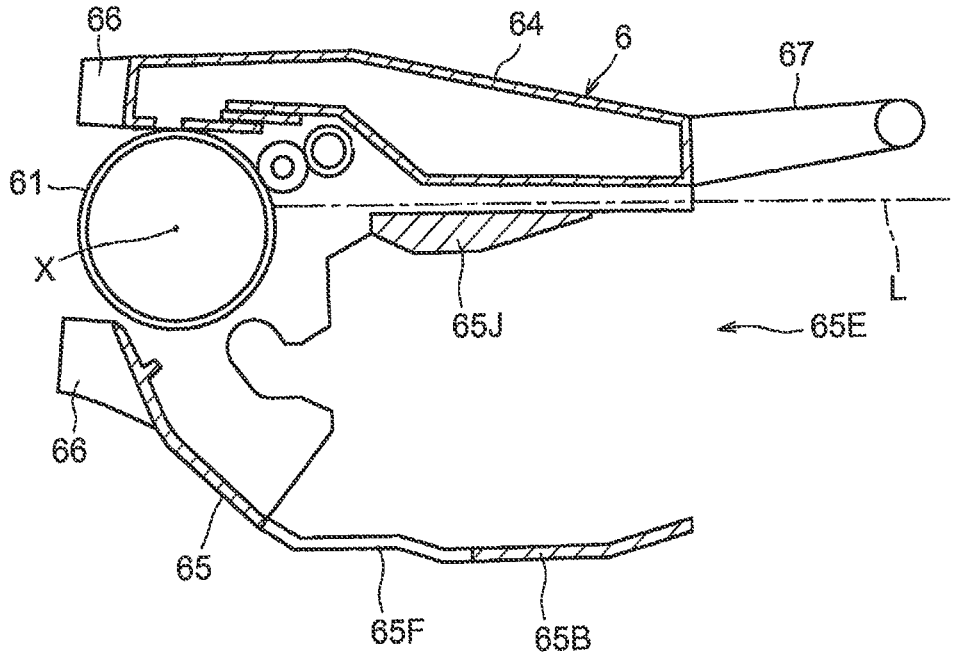
FIG. 10B is a sectional view intersecting with the axial direction, depicting a photosensitive body cartridge in a second variation of the illustrative embodiment according to one or more aspects of the disclosure.

In other embodiments, for example, as depicted in FIG. 10B, the frame 65 may include an intermediate wall 65J for positioning the developing cartridge (not depicted) between the lower wall 65B and the intermediate wall 65J and the right and left sidewalls of the frame 65 may be cut out largely from the opening 65E. In this case, the developing cartridge 7 may be attached to and detached from the photosensitive body cartridge 6 via the opening 65E that is defined by the front edge of the lower wall 65B and the front edge of the waste toner storage container 64.

An entire portion of the opening 65E might not necessarily be enclosed by one or more edges entirely. That is, the one or more edges defining the opening 65E might not necessarily connect with each other. In an example depicted in FIG. 10B, a laser beam L entering the photosensitive body cartridge 6 via the opening 65E may travel in a space between the intermediate wall 65J and the waste toner storage container 64 and irradiates the surface of the photosensitive drum 61.

In other embodiments, for example, the process cartridge 5 may be a process cartridge of noncontact developing type in which the developing roller 71 of the developing cartridge 7 is not in contact with the surface of the photosensitive drum 61 of the photosensitive body cartridge 6. The developing cartridge 7 may include a developing sleeve in which a magnet roller is disposed, instead of the developing roller 71.

The waste toner storage container 64 may be configured to store waste toner collected from the surface of the charging roller 63. The waste toner storage container 64 and the handle 67 may have a one-piece body or may be separate parts. The handle 78 of the developing cartridge 7 and the frame 76 of the developing cartridge 7 may have a one-piece body or may be separate parts.

The photosensitive drum 61 may include a metal rotating shaft that passes through the drum body 61A in the elongated direction of the photosensitive drum 61, and the photosensitive body cartridge 6 may be rotated on the rotating shaft with respect to the casing 2. Driving force may be inputted directly to the developing cartridge 7 from the casing 2.

In the illustrative embodiment, the process cartridge 5 is configured to be pivotable on the axial (X) direction. Nevertheless, in other embodiments, for example, the process cartridge 5 may be configured to be pivotable on another axis that is different from the axis X of the photosensitive drum 61 and extends in parallel to the axis X of the photosensitive drum 61.

What is claimed is:

1. An image forming apparatus comprising:

a main body; and a process cartridge including:

a photosensitive body cartridge including:

a photosensitive body configured to rotate on an axis; and a waste developing agent storage container configured to store a developing agent collected from the photosensitive body; and a developing cartridge including a developing agent carrier configured to supply the developing agent to the photosensitive body, wherein the photosensitive body cartridge is configured to receive the developing cartridge such that the developing cartridge is attached to and detached from the photosensitive body cartridge through a particular space with respect to a direction orthogonal to the axis, the particular space being defined in the main body, and wherein the process cartridge is configured to pivot, with respect to the main body, between a first position, in which the waste developing agent storage container is positioned outside the particular space entirely, and a second position, in which the waste developing agent storage container at least partially occupies the particular space.

2. The image forming apparatus according claim 1, further comprising an exposing unit configured to expose a surface of the photosensitive body with a laser beam, wherein when the process cartridge is located at the first position, the developing cartridge occupies a space including an optical path of the laser beam, and wherein when the process cartridge is located at the second position, the developing cartridge allows the laser beam to travel between the waste developing agent storage container and the developing cartridge.

3. The image forming apparatus according claim 1, wherein the photosensitive body cartridge is configured to be attached to and detached from the main body and includes a first guided portion and a second guided portion for allowing the process cartridge to pivot between the first position and the second position, and wherein the main body includes:

a first guide configured to engage with the first guided portion and guide the first guided portion when the process cartridge moves to the first position from the outside of the main body;

a second guide configured to engage with the second guided portion and guide the second guided portion when the process cartridge pivots from the first position to the second position.

4. The image forming apparatus according claim 3, wherein the first guided portion has the axis as its center and extends along an axial direction in which the axis extends.

5. The image forming apparatus according claim 3, wherein the main body further includes a third guide configured to engage with the second guided portion and guide the second guided portion when the process cartridge moves to the first position from the outside of the main body.

6. The image forming apparatus according claim 1, further comprising:

a cover attached to the main body and configured to open and close the particular space; and an interlocking mechanism configured to interlock with opening and closing of the cover, wherein the process cartridge is configured to pivot between the first position and the second position by the interlocking mechanism.

7. The image forming apparatus according claim 2, wherein the main body has a main opening, wherein the photosensitive body cartridge includes a handle, and wherein the handle is positioned closer to the main opening than the optical path of the laser beam when the process cartridge is located at the second position.

8. The image forming apparatus according claim 7, wherein when the process cartridge is located at the first position, the handle extends from the waste developing agent storage container toward the main opening.

9. The image forming apparatus according claim 1, wherein when the process cartridge is located at the first position, the waste developing agent storage container traverses a conveying path for conveying a recording sheet having an image transferred from the photosensitive body.

10. The image forming apparatus according claim 1, wherein the photosensitive body cartridge has an opening portion from which a portion of the photosensitive body is exposed, and foot portions facing each other across the opening portion, wherein the foot portions protrude more outward than the photosensitive body.

11. The image forming apparatus according claim 1, wherein the main body further includes a pressing portion configured to press the developing cartridge toward the photosensitive body.

12. The image forming apparatus according claim 1, further comprising:

a feed tray disposed below the process cartridge; and a discharge tray disposed above the process cartridge, wherein a recording sheet is conveyed from the feed tray toward the photosensitive body via a first conveying path, in which the recording sheet is bended upwardly on one side in a horizontal direction in the main body, and the recording sheet is conveyed from the photosensitive body to the discharge tray via a second conveying path, in which the recording sheet is bended toward the other side in the horizontal direction in the main body.

13. The image forming apparatus according claim 1, wherein the main body has a main opening, wherein the photosensitive body cartridge includes a cartridge opening through which the developing cartridge is attached to or detached from the photosensitive body cartridge, and wherein when the process cartridge is located at the first position, the cartridge opening faces the main opening of the main body.

14. The image forming apparatus according claim 13, further comprising an exposing unit configured to expose a surface of the photosensitive body with a laser beam, wherein when the process cartridge is located at the second position, the exposing unit is allowed to expose the surface of the photosensitive body via the cartridge opening.

15. The image forming apparatus according claim 1, wherein the process cartridge is configured to pivot on the axis of the photosensitive body.

16. The image forming apparatus according claim 1, wherein when the process cartridge is located at the first position, the process cartridge extends along the particular space, and wherein when the process cartridge is located at the second position, the process cartridge extends substantially horizontally.

17. The image forming apparatus according claim 6, wherein the process cartridge is pivoted to the second position in response to closing of the cover, and wherein the process cartridge is pivoted to the first position in response to opening of the cover.

18. The image forming apparatus according claim 1, wherein the waste developing agent storage container has a thin box shape extending in a direction that the axis of the photosensitive body extends and extends so as to cover an upper portion of the developing cartridge.

19. The image forming apparatus according claim 1, wherein the waste developing agent storage container includes a cleaning blade configured to be in contact with the surface of the photosensitive body and collect the developing agent from a surface of the photosensitive body.

20. The image forming apparatus according claim 6, wherein the interlocking mechanism includes a gear train.

21. An image forming apparatus comprising:

a main body having a main opening;

a process cartridge including:

a photosensitive body cartridge including a photosensitive body configured to rotate on an axis; and a developing cartridge including a developing agent carrier configured to supply a developing agent to the photosensitive body, the photosensitive body cartridge being configured to receive the developing cartridge such that the developing cartridge is attached to the photosensitive body cartridge in a particular direction and detached from the photosensitive body cartridge;

a feeding unit including a feed roller disposed below the process cartridge and a feed tray configured to support one or more recording sheets;

a fixing unit disposed above the process cartridge;

a discharge tray configured to support the one or more recording sheets which have passed the fixing unit; and an exposing unit disposed between the feed tray and the discharge tray in a vertical direction, wherein the photosensitive body cartridge includes:

a waste developing agent storage container extending so as to cover an upper portion of the developing cartridge and configured to store therein the developing agent collected from a surface of the photosensitive body; and a frame having a cartridge opening through which the developing cartridge is attached to or detached from the photosensitive body cartridge, wherein the cartridge opening is defined in a portion upstream of the developing agent carrier in the particular direction, wherein the developing cartridge is configured to be attached to and detached from the photosensitive body cartridge via the main opening of the main body which is closed and exposed by the discharge tray, wherein the process cartridge is configured to pivot between a first position and a second position on another axis extending in parallel to the axis, wherein when the process cartridge is located at the first position, the cartridge opening faces the main opening of the main body, and when the process cartridge is located at the second position, the exposing unit is allowed to expose the surface of the photosensitive body via the cartridge opening.

* * * * *